US006684950B2

(12) United States Patent
Patel

(10) Patent No.: US 6,684,950 B2
(45) Date of Patent: Feb. 3, 2004

(54) SYSTEM FOR PRESSURE TESTING TUBING

(75) Inventor: Dinesh R. Patel, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 61 days.

(21) Appl. No.: 10/085,014

(22) Filed: Feb. 28, 2002

(65) Prior Publication Data

US 2002/0121373 A1 Sep. 5, 2002

Related U.S. Application Data

(60) Provisional application No. 60/275,445, filed on Mar. 13, 2001, and provisional application No. 60/272,646, filed on Mar. 1, 2001.

(51) Int. Cl.[7] ..... E21B 34/10; E21B 43/12

(52) U.S. Cl. ..... 166/250.01; 166/250.17; 166/120; 166/321; 166/325; 166/332.8

(58) Field of Search ..... 166/250.01, 250.17, 166/373, 374, 375, 386, 387, 179, 120, 316, 317, 319, 321, 323, 325, 336, 332.1, 332.3, 332.8, 334.1, 334.2

(56) References Cited

U.S. PATENT DOCUMENTS 3,470,903 A * 10/1969 Scott ..... 137/467
4,105,075 A * 8/1978 Helmus ..... 166/321
4,122,898 A * 10/1978 Nelson ..... 166/325
4,125,165 A * 11/1978 Helmus ..... 166/323
4,134,455 A * 1/1979 Read ..... 166/334.1
4,319,634 A * 3/1982 McMahan et al. ..... 166/250.08
4,627,492 A * 12/1986 MacLaughlin ..... 166/250.08
4,694,903 A * 9/1987 Ringgenberg ..... 166/250.08
4,871,019 A * 10/1989 Haley et al. ..... 166/167
4,979,568 A * 12/1990 Spencer et al. ..... 166/374
5,341,883 A * 8/1994 Ringgenberg ..... 166/324
5,649,597 A * 7/1997 Ringgenberg ..... 166/373
6,041,864 A * 3/2000 Patel et al. ..... 166/332.4
6,125,930 A * 10/2000 Moyes ..... 166/66
6,230,808 B1 * 5/2001 French et al. ..... 166/323
6,328,109 B1 * 12/2001 Pringle et al. ..... 166/373
6,349,770 B1 * 2/2002 Brooks et al. ..... 166/383
6,352,119 B1 * 3/2002 Patel ..... 166/386
2001/0042626 A1 * 11/2001 Patel ..... 166/386
2002/0066573 A1 * 6/2002 Patel ..... 166/374

* cited by examiner

*Primary Examiner*—Roger Schoeppel
(74) *Attorney, Agent, or Firm*—Van Someren, PC; Jeffrey E. Griffin; Brigitte Jeffery Echols

(57) ABSTRACT

A system and method is provided for pressure testing a tubing string. A valve is utilized within the tubing string to enable selective application of pressure in the tubing above the valve. However, between pressure tests, the valve may be opened to allow fluid flow into the tubing. Thus, the tubing string may readily be moved, for example, downhole into a wellbore with periodic application of pressure to test the tubing.

39 Claims, 7 Drawing Sheets

SYSTEM FOR PRESSURE TESTING TUBING

CROSS-REFERENCE TO RELATED APPLICATIONS

This application claims priority under 35 U.S.C. §119(e), to U.S. Provisional Patent Application Ser. No. 60/272,646, filed on Mar. 1, 2001, and U.S. Provisional Patent Application Ser. No. 60/275,445, filed on Mar. 13, 2001, both entitled "System for Pressure Testing Tubing".

FIELD OF THE INVENTION

The present invention relates generally to valve systems, and particularly to a valve system that may be utilized in pressure testing tubing, such as a tubing string deployed in a wellbore for the production of fluids.

BACKGROUND OF THE INVENTION

In pressure testing tubing, such as tubing strings utilized in downhole applications, current techniques tend to be relatively expensive and/or time-consuming. In a technique, a plug is run through the tubing on, for example, wireline, slick line or coil tubing, and deployed towards the bottom of the tubing string. A pressure test is conducted on the tubing, and then another run must be made to retrieve the plug.

Additionally, it is often necessary to test the tubing at several different depths. This, of course, requires multiple runs to set and remove the plug from the tubing. Other systems, such as sleeve valves, have been utilized, but the various other systems require substantial expense and/or substantial time-consuming intervention during deployment of the tubing.

SUMMARY OF THE INVENTION

The present invention features a valving technique for pressure testing tubing, such as tubing deployed in a wellbore for the production of one or more desired fluids.

BRIEF DESCRIPTION OF THE DRAWINGS

The invention will hereafter be described with reference to the accompanying drawings, wherein like reference numerals denote like elements.

DETAILED DESCRIPTION OF THE PREFERRED EMBODIMENTS

Figure 1:
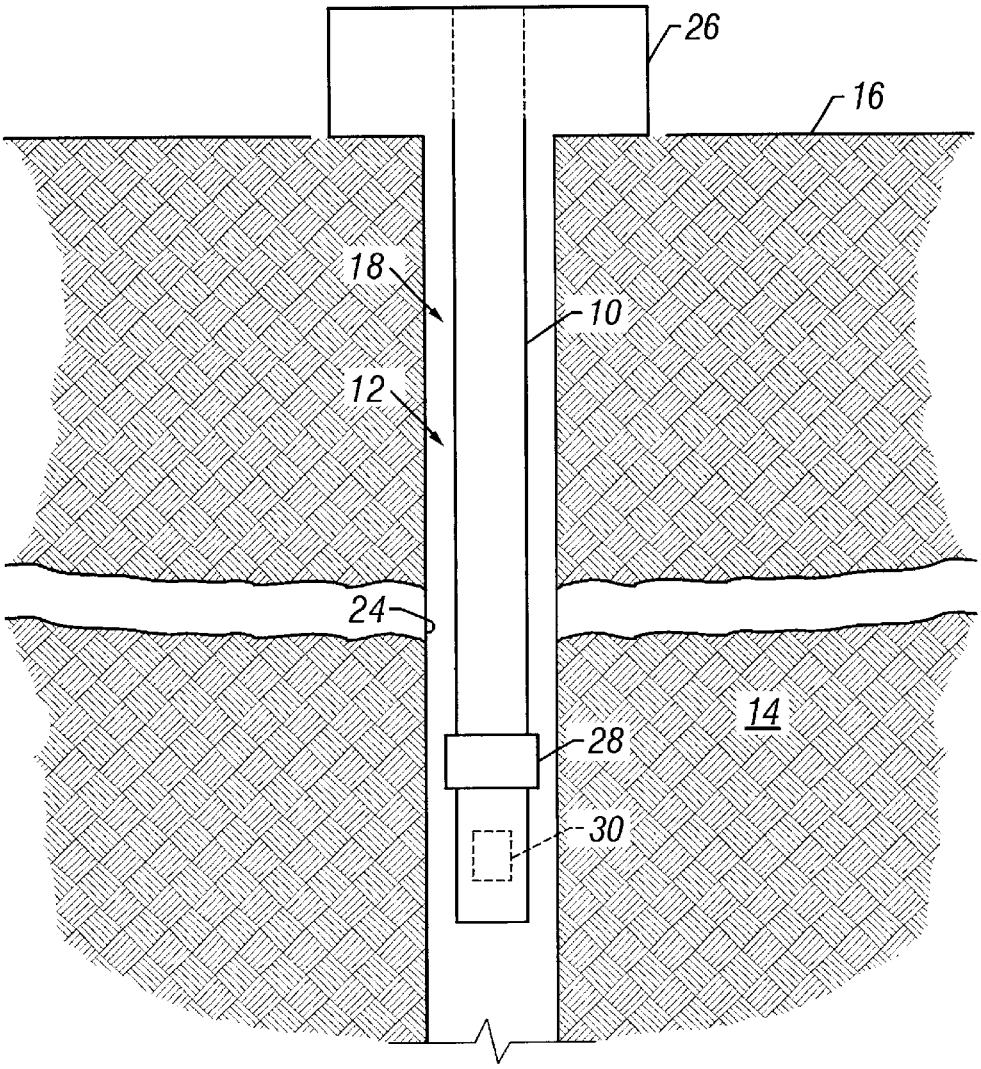
FIG. 1 is a front elevation view of an tubing system deployed within a wellbore.

Referring generally to FIG. 1, a tubing 10 is illustrated. Tubing 10 is illustrated in an environment in which the tubing may be subjected to various pressure tests during or subsequent to deployment. In this environment, tubing 10 is designed for deployment in a well 12 within a geological formation 14 formed beneath a surface 16, such as a subsea floor. Formation 14 typically contains desirable production fluids, such as petroleum.

In the example application of FIG. 1, a wellbore 18 is drilled and lined with a wellbore casing 24. Tubing 10 is suspended within wellbore casing 24 by, for example, a tubing hanger 26. Additionally, tubing 10 may be coupled to a variety of components, such as various completions and/or packers such as packer 28. Also, a valve system 30 cooperates with tubing 10 to permit selective pressure testing of the tubing.

Figure 2:
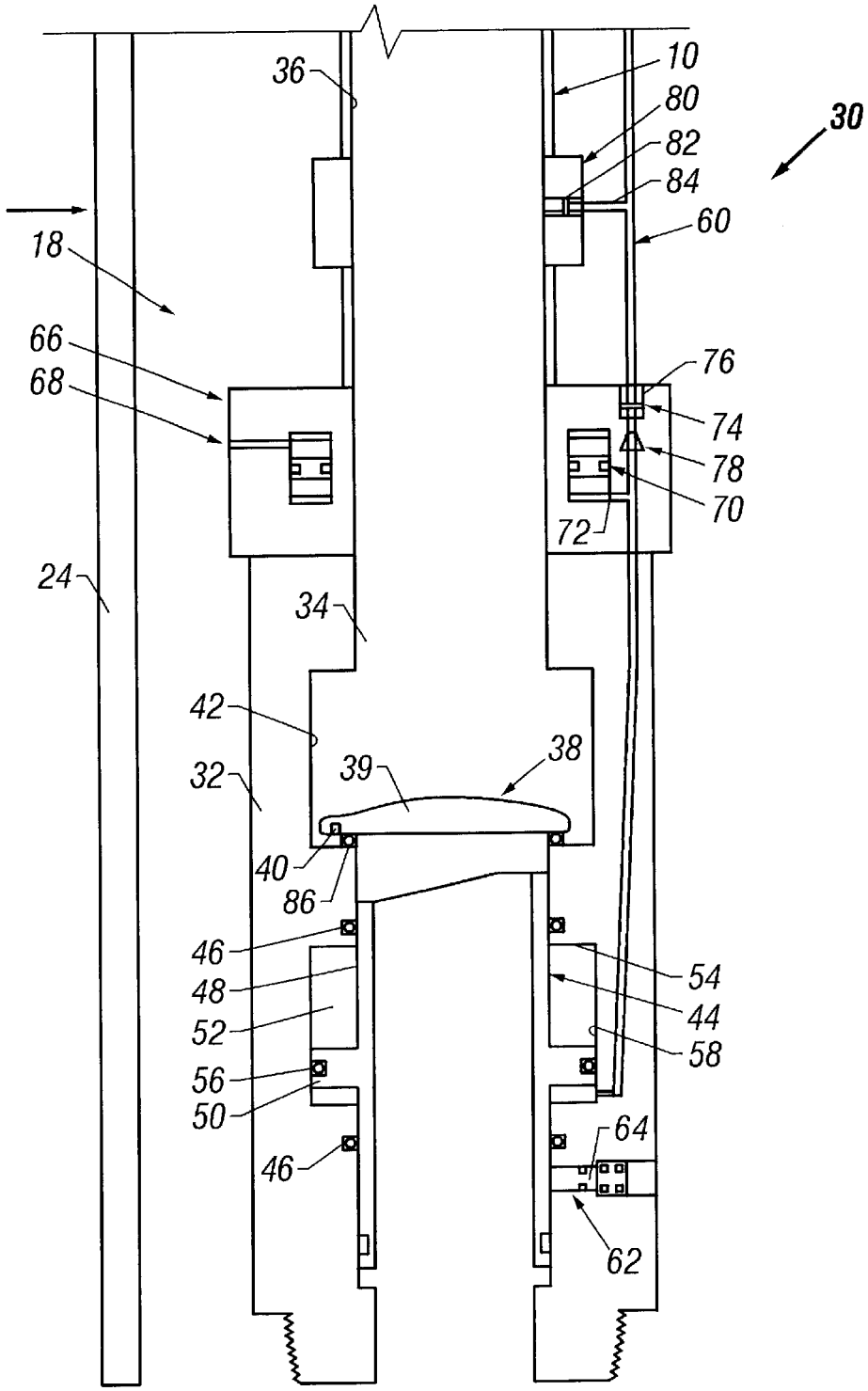
FIG. 2 is a front elevation view of a valve system, according to one embodiment of the present invention.

Referring generally to FIG. 2, an embodiment of valve system 30 comprises a housing 32 having a longitudinal opening 34 therethrough in fluid communication with a generally hollow interior 36 of tubing 10. Valve system 30 further comprises a valve 38, such as a flapper valve having a flapper 39, positioned to selectively close longitudinal opening 34. In the illustrated embodiment, the flapper valve is pivotably mounted about a pivot 40 that permits the valve to move between a closed position obstructing longitudinal opening 34 and an open position that leaves longitudinal opening 34 substantially unobstructed. A recess, such as an annular recess 42, may be formed to accommodate pivot 40 and to facilitate movement of flapper valve 38 to its unobstructed or open position.

Positioned beneath valve 38 is a mandrel 44. Mandrel 44 is slidably mounted within housing 32. One or more seals 46, such as O-ring seals may be disposed between an exterior surface 48 of mandrel 44 and housing 32. Mandrel 44 further includes an annular extended portion 50 that extends radially outward from exterior surface 48 and is received in an annular housing recess 52.

Annular housing recess 52 is sized to permit longitudinal sliding movement of annular extended portion 50*a* sufficient distance to permit closure of valve 38 or, alternatively, movement of valve 38 to its fully open position by the time annular extended portion 50 abuts an upper surface 54 that defines the top of annular housing recess 52. Furthermore, a seal 56 may be disposed about the perimeter of annular extended portion 50 to form a seal between annular extended portion 50 and a side surface 58. Side surface 58 defines the radial outer limit of annular housing recess 52.

A control line 60 is coupled in fluid communication with annular housing recess 52 at a location beneath annular extended portion 50. Thus, a control fluid may be conducted through control line 60 and into annular housing recess 52 beneath annular extended portion 50. Upon application of sufficient pressurized fluid against the bottom of annular extended portion 50, mandrel 44 is driven upwardly to force valve 38 to its open position. A retention mechanism 62 may be used to lock mandrel 44 in this upward position to maintain valve 38 in an open state. Example retention mechanisms 62 comprise ratchet mechanisms or the illustrated spring-loaded lock pin 64.

Other features of valve system 30 may comprise a packer 66 having a casing pressure port 68 and a packer setting piston 70. Casing pressure port 68 provides fluid communication between the annulus and an upper side of piston 70. Packer setting piston 70 permits packer 66 to be set at a desired location within wellbore 18 by, for example, hydraulic actuation. An example packer is a differential set packer.

In the illustrated embodiment, control line 60 also is coupled to packer setting piston 70 to facilitate the setting of packer 66. Packer 66 may be set by introduction of fluid through control line 60 at sufficient pressure to actuate piston 70. Control line 60 is coupled to packer setting piston 70 via a control port 72.

A flow limiting device 74 is deployed in control line 60 upstream from control port 72 to stop unwanted flow of control fluid to either annular housing recess 52 or packer setting piston 70. An example flow limiting device 74 comprises a rupture disk 76. Prior to rupture, rupture disk 76 prevents hydrostatic pressure, due to fluid in control line 60 above rupture disk 76, from acting against the bottom of annular extended portion 50.

Additionally, an optional check valve 78 is deployed in control line 60 to permit forward flow while preventing back flow of wellbore fluids into control line 60. Check valve 78 stops the flow of production fluid through control line 60 if the seals around mandrel 44 fail. Check valve 78 may be located at a downstream position from flow limiting device 74, as illustrated in FIG. 2.

Optionally, system 30 includes a chemical injection port 80 having a flow limiting device 82. An example flow limiting device 82 comprises a rupture disk 84. In the illustrated design, rupture disk 84 requires a greater pressure for rupture than rupture disk 76.

To operate valve system 30, sufficient pressure is applied to the control fluid in control line 60 to create a rupture of rupture disk 76. The pressurized fluid flows to annular housing recess 52 beneath annular extended portion 50 and forces mandrel 44 upward to open valve 38. Upon sufficient upward movement, retention mechanism 62 actuates to hold mandrel 44 in a raised position and valve 38 in an open position. Upon application of additional pressure, packer setting piston 70 is actuated to set packer 66 at the desired location along wellbore casing 24. Subsequently, additional pressure may be applied to burst rupture disk 84 and create a flow path through chemical injection port 80. Once this flow path is established, a variety of chemicals, such as rust inhibitors, can be injected into tubing 10.

In an example application, tubing 10 and valve system 30 are run downhole within wellbore 18. During running, wellbore fluid tends to flex flapper 39 upwardly to permit the flow of fluid into hollow interior 36 of tubing 10. Downward movement may be halted one or more times to permit closing of valve 38 and pressure testing of tubing 10 against the closed valve 38. A spring 86 may be used to bias the flapper of valve 38 to the closed position.

Once at the desired depth, an operator can "land out" the tubing hanger 26 and perform a final tubing pressure test. Following the pressure test, sufficient pressure is applied to the control fluid in control line 60 to burst rupture disk 76 disposed in or proximate packer 66. The control line fluid is used to push mandrel 44 up through valve 38 until retention mechanism 62 locks mandrel 44 and valve 38 in an open position.

After locking valve 38 in an open position, pressure is applied in the tubing to pressure test tubing hanger 26 from below. Subsequently, the fluid within tubing 10 is replaced with a lighter cushion fluid to, for example, stimulate flow. Additionally, pressure in the control line is increased above the packer setting pressure which moves packer setting piston 70 and sets packer 66 within wellbore casing 24. In this example, the packer is set subsequent to displacing the tubing fluid within the lighter cushion fluid. Once set, the packer 66 may be pressure tested from below by applying pressure in the tubing 10. If desired, the pressure in control line 60 may be raised to yet a higher pressure sufficient to burst rupture disk 84 in chemical injection port 80. This allows fluid in control line 60 to be pumped into hollow interior 36 of tubing 10. In this particular embodiment, the pressure required to set packer 66 is greater than the pressure required to raise mandrel 44 to a locked position, and the pressure required to burst rupture disk 84 is greater than the pressure required to set packer 66.

Figure 3:
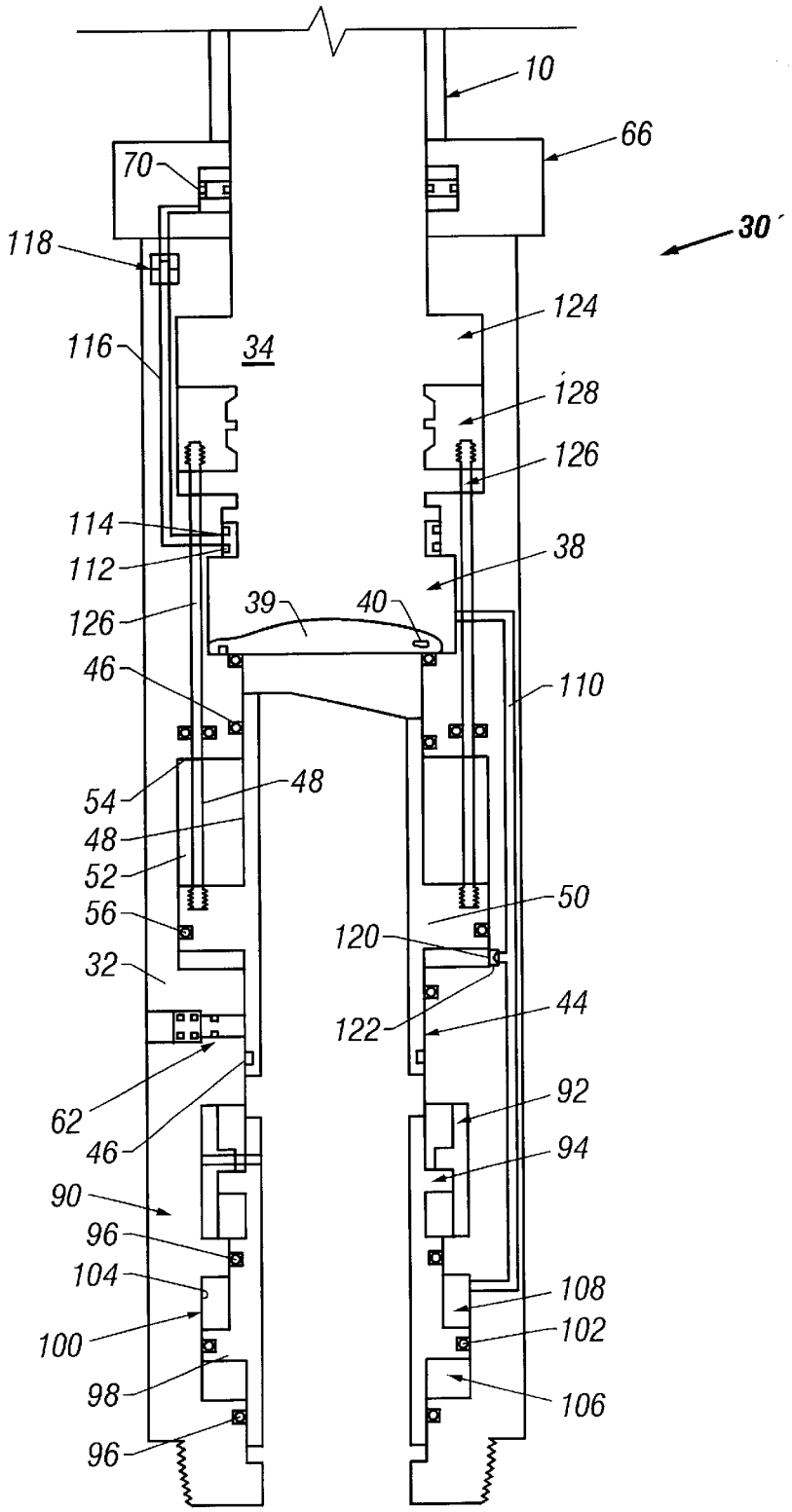
FIG. 3 is a front elevation view similar to FIG. 2 showing an alternate embodiment of the invention.

Referring generally to FIG. 3, an alternate embodiment of valve system 30, labeled 30', is illustrated. It should be noted that common or substantially common elements retain the same reference numerals in this and subsequent alternate embodiments. In this embodiment, an indexer 90 is coupled to housing 32 beneath mandrel 44. An example indexer 90 comprises an index counter sleeve 92 that cooperates with an index mandrel 94. One or more index mandrel seals 96 are deployed between index mandrel 94 and housing 32.

Index mandrel 94 also comprises a radial extension 98 that is received in an annular recess 100 formed in housing 32. A seal 102 may be deployed between radial extension 98 and a sidewall 104 of annular recess 100.

A biasing element 106 is deployed in annular recess 100 beneath radial extension 98. An example biasing element 106 comprises a gas spring, such as an $N_2$ gas spring. Also, within annular recess 100, a chamber 108 is formed above radial extension 98 and placed in fluid communication with the interior of tubing 10 via a fluid conduit 110.

As known to those of ordinary skill in the art, indexers, such as indexer 90, rotate each time a sufficient pressure increase/decrease (cycle) acts against the index mandrel until a predetermined number of pressure cycles release the index mandrel. In the embodiment illustrated, each time tubing 10 is pressure tested, the pressure acts against radial extension 98 via fluid conduit 110 and rotates index mandrel 94 a predetermined amount. Upon reaching the predetermined number of pressure tests (cycles), index mandrel 94 is released, and biasing element 106 pushes index mandrel 94 upward into mandrel 44, pushing mandrel 44 upward until locked in place by retention mechanism 62.

In this embodiment, as mandrel 44 forces valve 38 towards an open position, the upper portion of mandrel 44 abuts a pressure isolation sleeve 112. As mandrel 44 continues to move, pressure isolation sleeve 112 is forced upwardly to expose a fluid port 114 disposed in housing 32. Fluid port 114 provides fluid communication between the longitudinal opening 34/hollow interior 36 and a fluid conduit 116 which leads to packer setting piston 70 of packer 66. A flow limiting device, such as a rupture disk 118, may be placed across fluid conduit 116. Thus, when pressure isolation sleeve 112 is moved by mandrel 44 to expose fluid port 114, the fluid in hollow interior 36 of tubing 10 can be pressurized to set packer 66. Specifically, the pressure is increased to a sufficient level to burst rupture disk 118 and move packer setting piston 70 to set the packer.

In an example application, execution of a predetermined number of tubing pressure tests (cycles) indexes indexer 90 to a position where index mandrel 94 is released from indexer 90 and is forced upwardly against mandrel 44. This action moves mandrel 44 to its open or locked position which, in turn, moves pressure isolation sleeve 112 to expose fluid port 114. Subsequently, hollow interior 36 and longitudinal opening 34 may be pressurized sufficiently to burst rupture disk 118, actuate packer setting piston 70 and set packer 66. Each of the activities may be accomplished without a separate control line extending to the surface.

Other features of the example valve system 30 may be added individually or collectively to further ensure proper actuation of valve 38. For example, fluid conduit 110 may be fluidically coupled with annular housing recess 52 generally beneath annular extended portion 50 via a port 120. A flow limiting device 122, such as a rupture disk, may be deployed for cooperation with port 120. Under normal operation, fluid flows along fluid conduit 110 to indexer 90, thereby bypassing port 120 and flow limiting device 122. However, if indexer 90 should fail to function (or earlier actuation of mandrel 44 is desired), the pressure in hollow interior 36 and longitudinal opening 34 may be raised sufficiently to create flow through flow limiting device 122 and port 120, e.g. by bursting the rupture disk. The annular housing recess 52 beneath annular extended portion 50 is then sufficiently pressurized to drive mandrel 44 upwardly to its locked or open position.

Another optional backup system that can be incorporated with a variety of valve system designs to ensure opening of valve 38 is a mechanical system 124. An example mechanical system 124 comprises one or more link rods 126 coupled between mandrel 44 and a mechanical latch 128. Mechanical latch 128 is designed to engage an appropriate mechanical tool run through hollow interior 36 of tubing 10. The mechanical tool can be used to physically pull mandrel 44 upward to its locked position. In the embodiment illustrated, link rods 126 extend longitudinally through a portion of housing 32 and annular housing recess 52 to engage annular extended portion 50 by, for example, threaded engagement.

An example application of the system illustrated in FIG. 3 is similar to that described above with reference to FIG. 2. Tubing 10 and valve system 30' are run downhole within wellbore 18. During running, wellbore fluid tends to flex flapper 39 upwardly to permit the flow of fluid into hollow interior 36 of tubing 10. Downward translation is halted a predetermined number of times to permit closing of valve 38 and pressure testing of tubing 10 against the closed valve 38. Each pressure test indexes indexer 90.

Once at the desired depth, an operator can "land out" the tubing hanger 26 and perform a final tubing pressure test. Following the final pressure test, index mandrel 94 is released and valve 38 is opened and locked in the open position by retention mechanism 62.

After locking valve 38 in an open position, pressure is applied in the tubing to pressure test tubing hanger 26 from below. Subsequently, the fluid within tubing 10 is replaced with a lighter cushion fluid to, for example, stimulate flow. Additionally, pressure in tubing 10 is increased above the pressure required to burst rupture disk 118 via fluid conduit 116. Packer setting piston 70 is then actuated to set packer 66 within wellbore casing 24. Once the packer is set, the packer 66 may be pressure tested from below by applying pressure in the tubing 10.

Figure 4:
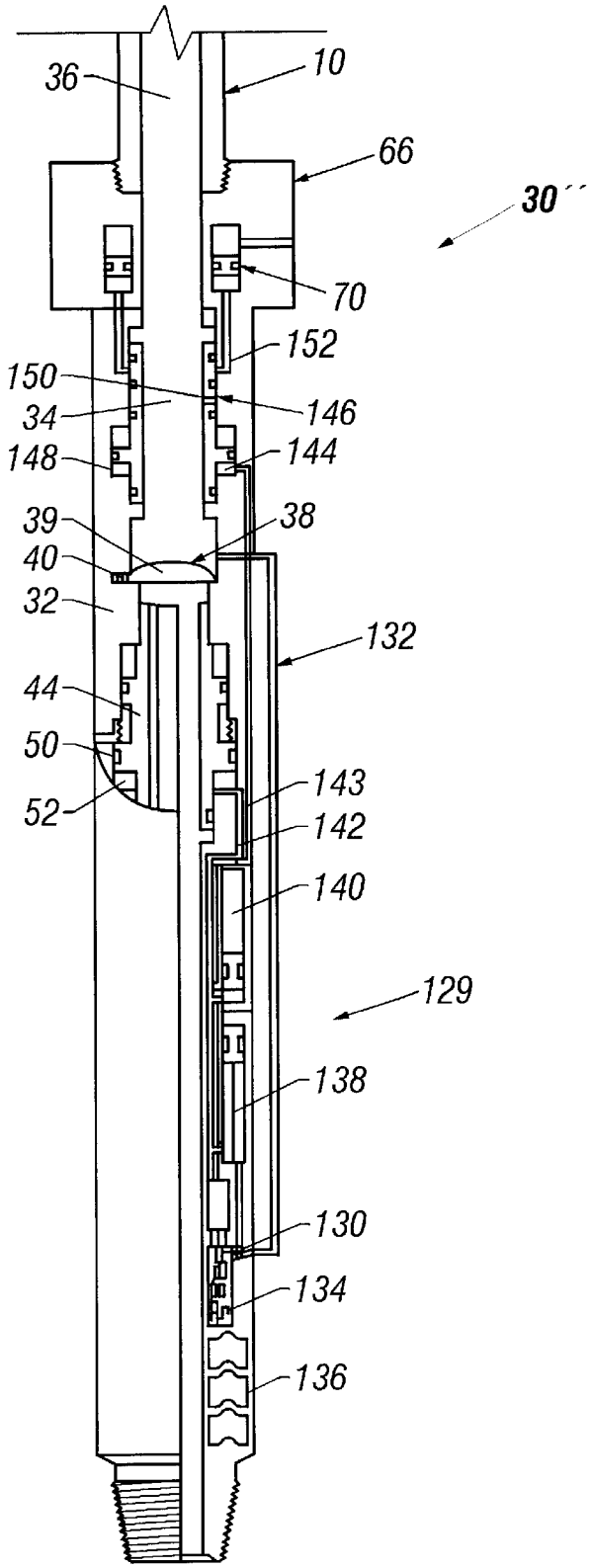
FIG. 4 is a front elevation view similar to FIG. 2 showing another alternate embodiment of the present invention.

Another example embodiment of valve system 30, labeled 30", combines valve 38, e.g. a flapper valve, with an intelligent remote implementation system (IRIS) 129 available from Schlumberger Corporation and known to those of ordinary skill in the art (see FIG. 4). For purposes of explanation, general elements of an intelligent remote implementation system will be described below, however, a variety of configurations and components can be utilized to provide appropriate pressure outputs to a variety of actuable components.

An example IRIS 129 comprises a pressure sensor 130 in fluid communication with longitudinal opening 34 or the annulus via a control line 132 routed to longitudinal opening 34 or the annulus as appropriate. Pressure sensor 130 also is coupled to electronics 134 powered by a battery 136. The electronics 134 are designed to compare pressure pulses (e.g. the amplitude and time interval) received through control line 132 with values in a database to determine whether a match exists and, if so, the appropriate response. For example, IRIS 129 also may comprise a hydrostatic chamber 138 and an atmospheric chamber 140 appropriately coupled to an output line or lines 142, 143. Controlling pressure pulses can be output through those lines 142, 143 via chambers 138 and 140 when the electronics 134 determines an appropriate match between pressure pulses received through control line 132 and stored values.

In this particular example, line 142 may be coupled to, for example, the annular housing recess 52 beneath annular extended portion 50. Line 143 may be coupled to a similar annular chamber 144 designed for receiving an isolation piston 146 that is used in actuating setting piston 70 of packer 66.

Upon an appropriate pressure signal via control line 132, IRIS 129 causes a fluid to be discharged through line 142 to annular housing recess 52. This fluid causes mandrel 44 to rise, as described above, opening valve 38. Typically, the fluid acts against a spring bias that tends to bias mandrel 44 and/or valve 38 to a closed position. This allows mandrel 44 and valve 38 to be moved to a closed position if fluid pressure within line 142 and annular housing recess 52 is sufficiently lowered.

Similarly, after receiving an appropriate pressure signal via control line 132, IRIS 129 moves pressurized fluid through line 143 to act against isolation piston 146 via an annular extended portion 148 disposed in annular chamber 144 similar to the arrangement of mandrel 44. The pressure causes isolation piston 146 to rise until an isolation piston port 150 is aligned generally between longitudinal opening 34 and a packer setting piston control line 152. This permits fluid pressure from within hollow interior 36 and longitudinal opening 34 to be applied against packer setting piston 70 for setting packer 66. Thus, IRIS 129 permits substantial control over the actuation of both valve 38 and packer 66.

In an example application of the embodiment of valve system 30" illustrated in FIG. 4, the system is deployed downhole beneath tubing hanger 26 positioned, for example, at a subsea surface. As system 30" is run downhole, tubing 10 fills through valve 38, e.g. through the flapper 39. At one or more locations, movement downhole is halted and tubing 10 is pressure tested against the closed flapper 39 of valve 38. At the final location, an operator "lands out" the tubing hanger and performs a final tubing pressure test. Then, an appropriate pressure signal, e.g. pressure pulse, is supplied to pressure sensor 130 via tubing 10 and control line 132. Assuming the pressure pulse matches an appropriate stored pulse characteristic, IRIS 129 causes the appropriate fluid flow through line 142 to move mandrel 44 and open valve 38. Subsequently, a pressure test is performed on tubing hanger 26 from below via tubing 10. Following pressure testing of tubing hanger 26, a cushion fluid is introduced through tubing 10 to stimulate the flow of desired wellbore fluids.

Upon addition of the cushion fluid, valve 38 is closed via an appropriate pulse command sent to IRIS 129 which releases the pressure in line 142 permitting the spring biased mandrel and/or valve 38 to return to a closed position. An appropriate pressure pulse is then provided to IRIS 129 to cause the movement of pressurized fluid through line 143 to annular chamber 144. The pressurized fluid further causes movement of isolation piston 146 such that port 150 is aligned with packer control line 152. Packer 66 is then set via pressure applied through tubing 10, port 150 and packer control line 152. Subsequently, a pressure pulse is provided to IRIS 129 that results in the opening of valve 38 to permit pressure testing of packer 66 from beneath. Following pressuring testing of packer 66, an optional pressure pulse may be supplied to IRIS 129 to disable the electronics, thereby maintaining valve 38 in an open position.

Figure 5A:
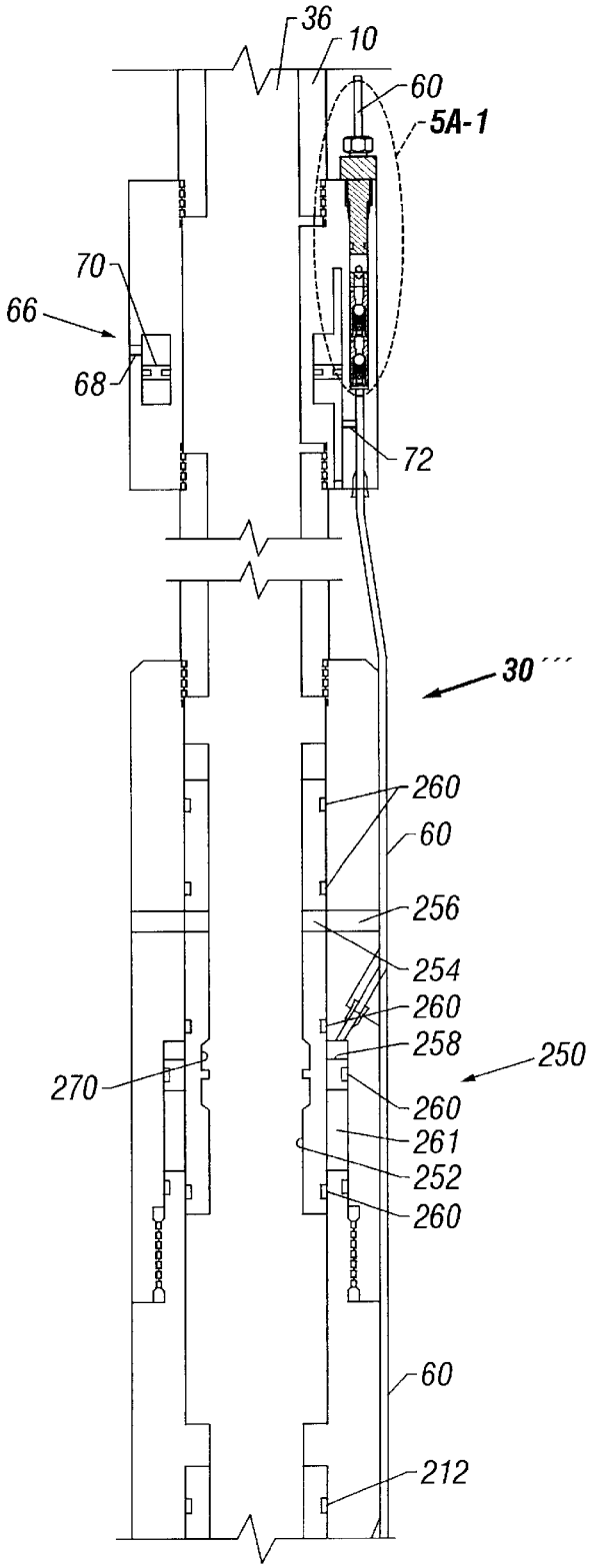
FIGS. 5A and 5B are a front elevation view showing another alternate embodiment of the present invention.
Figures 1, 5A:
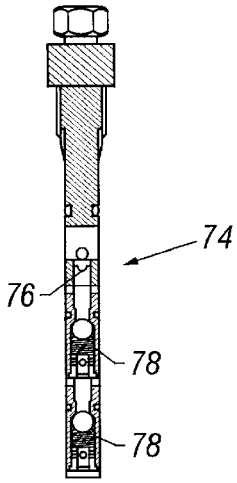
Figure 5B:
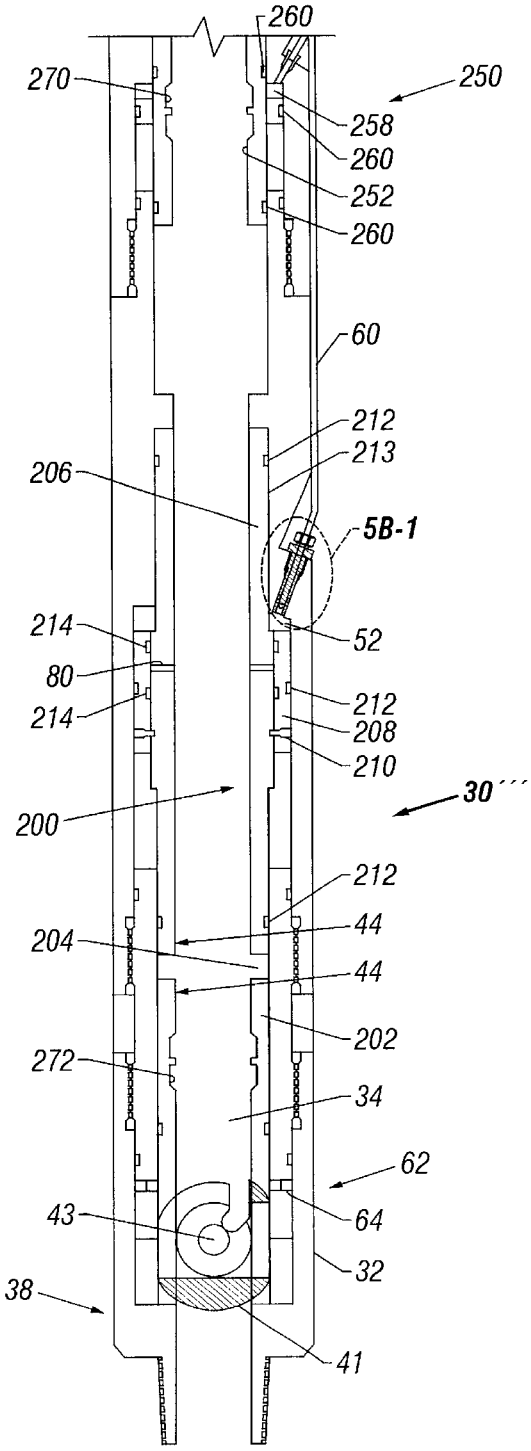
Figures 1, 5B:
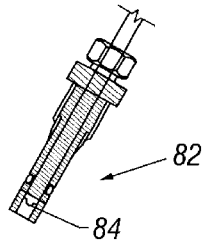

Referring generally to FIGS. 5A and 5B, an alternate embodiment of valve system 30, labeled 30''', is illustrated. This embodiment also includes housing 32, longitudinal opening 34, hollow interior 36, and valve system 30. The valve system 30 includes the valve 38, which in this embodiment comprises a ball valve 41, positioned to selectively close longitudinal opening 34. The ball valve 41 is pivotably mounted about a pivot 43 that permits the valve to move between a closed position obstructing longitudinal opening 34 and an open position that leaves longitudinal opening 34 substantially unobstructed.

Mandrel 44 is positioned above ball valve 41. Mandrel 44 is slidably mounted within longitudinal opening 34. The sliding movement of mandrel 44, as will be described herein, induces the opening and/or closing of ball valve 41. Mandrel 44 comprises a power mandrel 200 and a ball operator mandrel 202. Both the power mandrel 200 and the ball operator mandrel 202 are slidably mounted within longitudinal opening 34, with the power mandrel 200 mounted above the ball operator mandrel 202. In one embodiment, a gap 204 is defined between the power mandrel 200 and the ball operator mandrel 202.

Power mandrel 200 itself comprises a first section 206 and a second section 208. First section 206 is proximate the longitudinal opening 34, and second section 208 is intermediate the first section 206 and housing 32. First section 206 includes a chemical injection port 80 defined therethrough. First section 206 and second section 208 are releasably attached to each other by way of a shear pin 210.

One or more seals 212, such as O-ring seals, may be disposed between an exterior surface 213 of power mandrel 200 and housing 32. Further, seals 214, such as O-ring seals, may be disposed at either side of chemical injection port 80 between first section 206 and second section 208.

At least the second section 208 of power mandrel 200 is disposed in an annular housing recess 52. Annular housing recess 52 is sized to permit longitudinal sliding movement of power mandrel 200 a sufficient distance to permit power mandrel 200 to slide downwardly through gap 204, abut ball operator mandrel 202, and force the downward movement of ball operator mandrel 202 thereby opening valve 38.

A control line 60 is coupled in fluid communication with annular housing recess 52 at a location above second section 208. Thus, a control fluid may be conducted through control line 60 and into annular housing recess 52 above second section 208. Upon application of sufficient, pressurized fluid against the top of second section 208, power mandrel 200 (including first section 206 due to its shear pin 210 connection to second section 208) is driven downwardly to force valve 38 to its open position. The bottom end of the first section 206 of the power mandrel 200 crosses gap 204 and abuts the top end of the ball operator mandrel 202. Due to the abutting relationship between first section 206 and ball operator mandrel 202, further downward movement of the power mandrel 200 forces the ball operator mandrel 202 downward causing the opening of the ball valve 41 (by mechanisms known in the art). Once the ball valve 41 is open, the ball operator mandrel 202 can no longer move in the downward direction. Continued application of pressurized fluid through control line 60 at this point results in the shearing of shear pin 210 which in turn enables the pressurized fluid to force the second section 208 downwardly. Due to its downward movement, the second section 208 eventually uncovers the chemical injection port 80 defined in the first section 206 thereby providing fluid communication between the control line 60 and the chemical injection port 80.

A retention mechanism 62 may be utilized to lock ball operator mandrel 202 in this downward position to maintain valve 38 in an open state. Example retention mechanisms 62 comprise ratchet mechanisms or the illustrated spring-loaded lock pin 64.

In one embodiment, ball valve 41 and the mandrel 44 are splined to housing 32 so as to prevent relative rotation in case a milling operation of the ball valve 41 is required. Furthermore, the ball valve 41 may be constructed from an easily millable material, such as alloy steel.

Other features of valve system 30''' may comprise a packer 66 having a casing pressure port 68 and a packer setting piston 70. Casing pressure port 68 provides fluid communication between the annulus and an upper side of piston 70. Packer setting piston 70 permits packer 66 to be set at a desired location within wellbore 18 by, for example, hydraulic actuation. An example packer is a differential set packer.

In the illustrated embodiment, control line 60 also is coupled to packer setting piston 70 to facilitate the setting of packer 66. Packer 66 may be set by introduction of fluid through control line 60 at sufficient pressure to actuate piston 70. Control line 60 is coupled to packer setting piston 70 via a control port 72.

A flow limiting device 74 is deployed in control line 60 upstream from control port 72 to stop unwanted flow of control fluid to either annular housing recess 52 or packer setting piston 70. An example flow limiting device 74 comprises a rupture disk 76. Prior to rupture, rupture disk 76 prevents hydrostatic pressure, due to fluid in control line 60 above rupture disk 76, from acting against the packer setting piston 70, the power mandrel 200, or the circulating mandrel 252 (as described below).

Additionally, at least one optional check valve 78 is deployed in control line 60 to permit forward flow while preventing back flow of wellbore fluids into control line 60. The embodiment illustrated in FIG. 5 includes two check valves 78. Check valve 78 stops the flow of production fluid through control line 60 if the seals around mandrel 44 (or the other components downstream of check valves 78) fail. Check valve 78 may be located at a downstream position from flow limiting device 74, as illustrated in FIG. 5A.

As previously discussed, system 30''' includes a chemical injection port 80 that is in fluid communication with the control line 60 once shear pin 210 is sheared and second section 208 moves downwardly. Proximate the annular housing recess 52, control line 60 includes a flow limiting device 82. An example flow limiting device 82 comprises a rupture disk 84. In the illustrated design, rupture disk 84 requires a greater pressure for rupture than rupture disk 76.

In addition, system 30''' may also include a circulating valve 250. Circulating valve 250 includes a circulating mandrel 252 that is slidably mounted within longitudinal opening 34 and that include at least one mandrel fill port 254 defined radially therethrough. Circulating mandrel 252 slides against housing 32. Opposite the mandrel fill ports 254, housing 32 includes at least one housing fill port 256. Mandrel fill ports 254 are selectively aligned with housing fill ports 256. Seals 260, such as O-rings, may be disposed between the circulating mandrel 252 and housing 32. A seal 260 may be disposed at either side of mandrel fill ports 254.

Circulating mandrel 252 includes an annular extension 258 that is disposed in another annular housing recess 261. Annular housing recess 261 is sized to permit longitudinal sliding movement of circulating mandrel 252 a sufficient distance to permit circulating mandrel 252 to slide downwardly and move from a position in which mandrel fill ports 254 are aligned with housing fill ports 256 to a position in which mandrel fill ports 254 are not aligned with housing fill ports 256.

Control line 60 is coupled in fluid communication with annular housing recess 261 at a location above annular extension 258. Thus, a control fluid may be conducted through control line 60 and into annular housing recess 261 above annular extension 258. Upon application of sufficiently pressurized fluid against the top of annular extension 258, circulating mandrel 252 is driven downwardly to provide misalignment and prevent fluid communication between mandrel fill ports 254 and housing fill ports 256.

In one embodiment, the circulating valve 250 includes a locking mechanism (not shown) to permanently lock the circulating valve 250 in the closed position, once the circulating mandrel 252 is forced in the downward direction. Locking mechanism may comprise a spring loaded lock pin (similar to element 64) or a one way ratchet mechanism.

System 30''' also has several mechanical back-ups in case pressurizing the control line 60 does not result in activation of the circulating mandrel 252 and/or the ball operator mandrel 202. For example, the interior surface of the circulating mandrel 252 includes a first profile 270 that is engageable by a shifting tool to move the circulating mandrel 252 in the downward direction (to close circulating valve 250), as previously disclosed. And, the interior surface of the ball operator mandrel 202 includes a second profile 272 that is engageable by a shifting tool to move the ball operator mandrel 202 in the downward direction (to open ball valve 41), as previously disclosed.

To operate valve system 30''', sufficient pressure is applied to the control fluid in control line 60 to create a rupture of rupture disk 76. The pressurized fluid flows to annular housing recess 261 above annular extension 258 and forces circulating mandrel 252 downward to misalign and prevent fluid communication between mandrel fill ports 254 and housing fill ports 256. Upon application of additional pressure, packer setting piston 70 is actuated (through control port 72) to set packer 66 at the desired location along wellbore casing 24. Next, additional pressure is applied to burst rupture disk 84 and create a flow path between the control line 60 and the power mandrel 200. The pressurized fluid causes the downward movement of the power mandrel 200 and the ball operator mandrel 202 (as previously disclosed) to thereby open the ball valve 41. Upon sufficient downward movement, retention mechanism 62 actuates to hold ball operator mandrel 202 in the then current position and ball valve 41 in an open position. Continuous application of pressure through control line 60 results in the detachment of the second section 208 of the power mandrel 200 from the first section 206 of the power mandrel 200 thereby allowing the second section 208 to move downwardly. Downward motion of the second section 208 in turn uncovers the chemical injection port 80 providing fluid communication between the control line 60 and the chemical injection port 80. Once this flow path is established, a variety of chemicals, such as rust inhibitors, can be injected into tubing 10 through control line 60 and chemical injection port 80.

In an example application, tubing 10 and valve system 30''' are run downhole within wellbore 18. During running, ball valve 41 is in its closed configuration. At this point circulating valve 250 is arranged so that mandrel fill ports 254 are aligned and in fluid communication with housing fill ports 256. Thus, during running, wellbore fluids will automatically fill in the longitudinal opening 34 and the hollow interior 36 of tubing 10.

Once at the desired depth, an operator can "land out" the tubing hanger 26. The tubing hanger 26 can then be pressure tested from below through the open circulating valve 250. Subsequently, the fluid within tubing 10 is replaced with a lighter cushion fluid to, for example, stimulate flow.

Next, sufficient pressure is applied to the control fluid in control line 60 to burst rupture disk 76 disposed in or proximate packer 66. The control line fluid automatically closes the circulating valve 250 so that mandrel fill ports 254 are no longer in fluid communication with housing fill ports 256. Subsequent to the closing of the circulating valve 250, a pressure test of the tubing 10 is performed by pressuring up the interior 36.

The pressure in the control line is then increased above the packer setting pressure which moves packer setting piston 70 and sets packer 66 within wellbore casing 24. Once set, the packer 66 may be pressure tested from above by, for example, applying pressure in the annulus.

Subsequent to the packer pressure test, the pressure in the control line 60 is increased further to burst rupture disk 84. Once the disk 84 is burst, pressurized fluid pushes power mandrel 200 down, forcing ball operator mandrel 202 down thereby opening ball valve 41. Retention mechanism 62 locks ball operator mandrel 202 and ball valve 41 in an open position. At this point, the packer 66 may again be tested from below through the open ball valve 41 by pressuring up the tubing 10.

Continued application of pressure in the control line 60 results in the shearing of shear pin 210 and the independent downward movement of the second section 208 of power mandrel 200. Downward movement of the second section 208, in turn, uncovers chemical injection port 80 and provides fluid communication between the chemical injection port 80 and the control line 60. This allows fluid in control line 60 to be pumped into hollow interior 36 of tubing 10 through chemical injection port 80. In this particular embodiment, the pressure required to set packer 66 is greater than the pressure required to burst rupture disk 76, and the pressure required to burst rupture disk 84 is greater than the pressure required to set packer 66.

Figure 6:
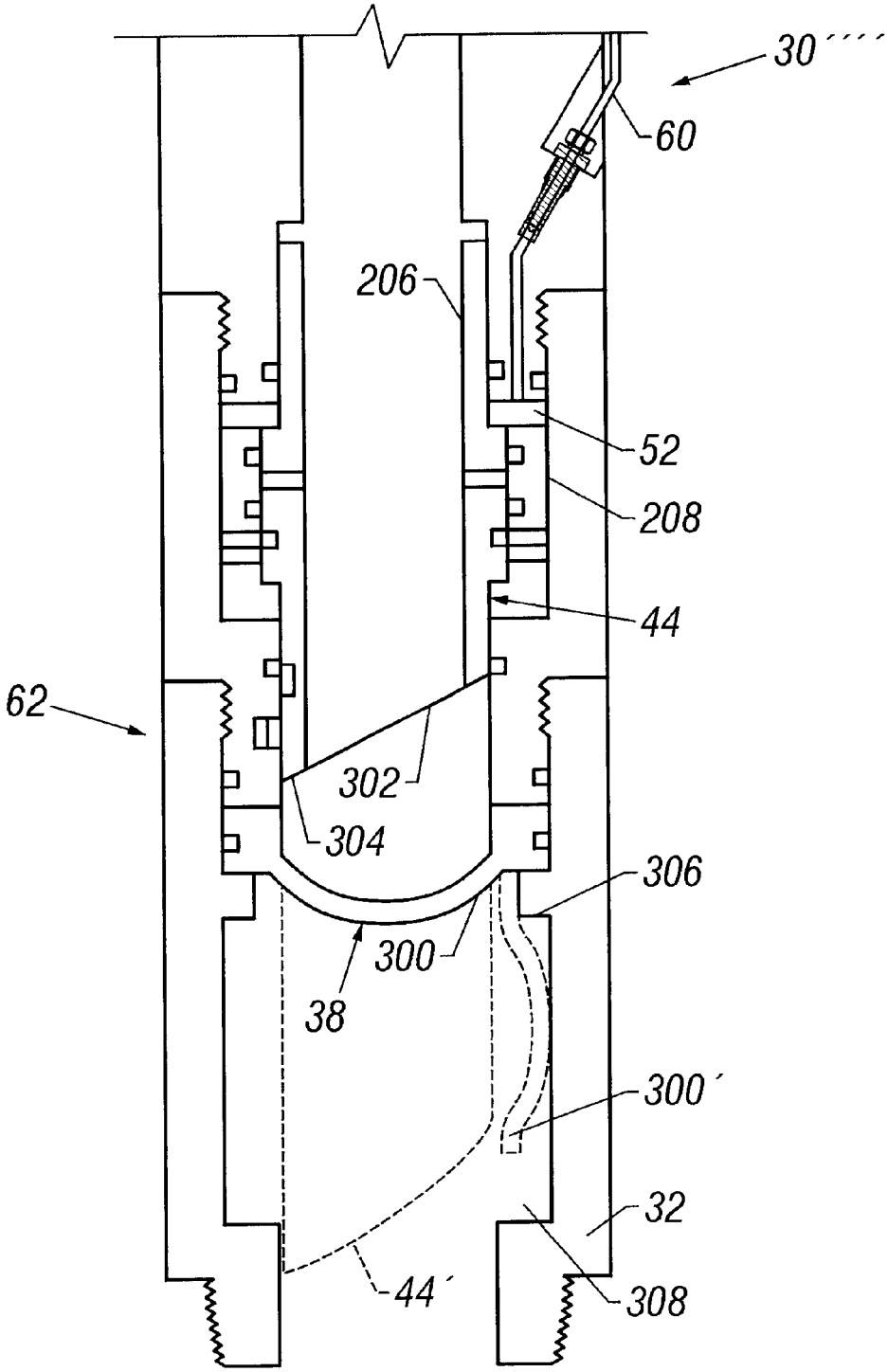
FIG. 6 is a front elevation view showing another alternate embodiment of the present invention.

Referring generally to FIG. 6, an alternate embodiment of valve system 30, labeled 30'''', is illustrated. This embodiment is very similar to the valve system 30''' illustrated in FIGS. 5A and 5B. Thus, only the differences between the two embodiments will be described.

Instead of including a ball valve 41, the valve 38 of valve system 30'''' comprises a disk valve 300 that is pierceable by the mandrel 44. Disk valve 300 is constructed from a piercable material, such as metal, and in its closed configuration completely obstructs the longitudinal opening 34. Mandrel 44 of this embodiment essentially comprises the power mandrel 200 illustrated and described with respect to FIG. 5. The mandrel 44 of this embodiment, however, does not include a ball operator mandrel 202. Like in the embodiment of FIG. 5, power mandrel 200 includes a first section 206 and a second section 208. However, the lower end 302 of first section 206 is shaped so that it may pierce the disk valve 300. In the embodiment shown in FIG. 6, the lower end 302 is cut at an angle from horizontal so as to provide an edge 304 to the first section 206.

As in the previous embodiment, pressurization of recess 52 above second section 208 through control line 60 forces the downward movement of power mandrel 200. As the power mandrel 200 moves down, the lower end 302 will eventually abut the disk valve 300. Continued pressurization will cause the edge 304 of lower end 302 to pierce through disk valve 300. Eventually, the first section 206 (mandrel 44', shown in phantom) moves through disk valve 300 piercing it so that disk valve 300' hangs from one end 306 within a recess 308. Mandrel 44' is locked in this position by retention mechanism 62 and thereby maintains the disk valve 300' in the open position. In the open position, the disk valve 300' provides an unobstructed passage in the longitudinal opening 34. All other aspects of this valve system 30"" are the same as the valve system 30'" of FIGS. 5A and 5B.

It will be understood that the foregoing description is of preferred embodiments of this invention, and that the invention is not limited to the specific forms shown. For example, the valve systems may be used in a variety of fluid moving applications; the arrangement of valve system components may be adapted to specific applications; the systems may or may not have redundant systems; and the components and configuration of any one or more redundant systems may vary. These and other modifications may be made in the design and arrangement of the elements without departing from the scope of the invention as expressed in the appended claims.

What is claimed is:

1. A system, to pressure test a tubing in a well, comprising:

a housing coupled to the tubing;

a flapper valve in the housing moveable between an opened position and a closed position, the flapper valve biased to the closed position in which the flapper valve seals pressure from above, and wherein the flapper valve is free to move from the closed position by flow applied from the bottom of the flapper valve to allow the flow of fluid into the tubing;

a mandrel moveably attached to the housing, the mandrel selectively moveable to open the flapper valve; and a retainer in the housing selectively moveable to maintain the flapper valve in the open position.

2. The system of claim 1 in which the housing has a flapper recess.

3. The system of claim 1 in which the mandrel slides relative to the housing.

4. The system of claim 1 in which:

the housing has a mandrel recess; and the mandrel has an extended portion disposed in the mandrel recess.

5. The system of claim 4 further comprising a control line to deliver pressurized fluid into the mandrel recess to bear on the extended portion.

6. The system of claim 1 in which the retainer is a biased pin.

7. A completion assembly used in a well comprising:

a tubing having a passageway;

a packer mounted to the tubing;

a housing coupled to the tubing;

a flapper valve in the housing moveable between an opened position and a closed position, the flapper valve biased to the closed position in which the flapper valve prevents flow through the passageway from above, and wherein the flapper valve is free to move from the closed position by flow from beneath the flapper valve to allow flow of fluid into the tubing;

a mandrel moveably attached to the housing, the mandrel selectively moveable to open the flapper valve;

a retainer in the housing selectively moveable to maintain the flapper valve in the open position; and a hydraulic control line through which different pressures are applied to independently move the mandrel and set the packer.

8. The completion assembly of claim 7 in which:

the housing has a mandrel recess; and the mandrel has an extended portion disposed in the mandrel recess.

9. The completion assembly of claim 7 further comprising a flow-limiting device in the hydraulic control line.

10. The completion assembly of claim 9 in which the flow-limiting device is a rupture disc.

11. The completion assembly of claim 7 in which the housing has a flapper recess.

12. The completion assembly of claim 7 further comprising an injection port mounted on the tubing.

13. The completion assembly of claim 12 further comprising a control line to deliver pressurized fluid to the injection port.

14. The completion assembly of claim 13 further comprising a flow-limiting device in the injection port to prevent fluid communication between the control line and the tubing until the flow-limiting device opens.

15. The completion assembly of claim 14 in which the flow-limiting device is a rupture disc.

16. The completion assembly of claim 7 further comprising:

an injection port mounted on the tubing;

a first flow-limiting device in the hydraulic control line; and a second flow-limiting device in the injection port.

17. The completion assembly of claim 16 in which the first flow-limiting device opens before the second flow-limiting device.

18. The completion assembly of claim 16 further comprising a check valve in the control line.

19. The completion assembly of claim 7 in which the retainer is a biased pin.

20. A completion assembly used in a well comprising:

a tubing having a passageway;

a housing coupled to the tubing;

a flapper valve in the housing moveable between an opened position and a closed position, the flapper valve biased to the closed position in which the flapper valve prevents flow through the passageway from above, and wherein the flapper valve is free to move from the closed position by flow from beneath the flapper valve to allow flow of fluid into the tubing;

a valve mandrel moveably attached to the housing, the valve mandrel selectively moveable to open the flapper valve;

a retainer in the housing selectively moveable to maintain the flapper valve in the open position;

an indexer coupled to the tubing; and a first conduit to allow fluid communication between the passageway and the indexer.

21. The completion assembly of claim 20 in which the indexer comprises a counter sleeve and an index mandrel.

22. The completion assembly of claim 21 in which the index mandrel has an extended portion that extends into a indexer recess, the extended portion being biased by a biasing element in the indexer recess.

23. The completion assembly of claim 21 in which the index mandrel exerts a force on the valve mandrel upon completion of a certain number of pressure cycles communicated through the first conduit.

24. The completion assembly of claim 20 further comprising a packer coupled to the tubing.

25. The completion assembly of claim 24 further comprising an isolation sleeve and a second conduit, the second conduit allowing fluid communication between the passageway and the packer when the isolation sleeve does not intervene between the passageway and the second conduit.

26. The completion assembly of claim 20 in which:

the housing has a valve mandrel recess; and the valve mandrel has an extended portion disposed in the valve mandrel recess.

27. The completion assembly of claim 26 further comprising a valve mandrel port having a flow-limiting device therein, the valve mandrel recess being in fluid communication with the first conduit when the flow-limiting device is open.

28. A completion assembly used in a well comprising:

a tubing having a passageway;

a housing coupled to the tubing;

a flapper valve in the housing moveable between an opened position and a closed position, the flapper valve biased to the closed position in which the flapper valve prevents flow through the passageway from above, and wherein the flapper valve is free to move from the closed position by flow from beneath the flapper valve to allow flow of fluid into the tubing;

a valve mandrel moveably attached to the housing, the valve mandrel selectively moveable to open the flapper valve;

a retainer in the housing selectively moveable to maintain the flapper valve in the open position;

an indexer coupled to the tubing;

a first conduit to allow fluid communication between the passageway and the indexer; and a link rod coupled between the valve mandrel and a latch.

29. A system to pressure test in a well, comprising:

a tubing having a passageway;

a housing coupled to the tubing;

a mandrel moveably attached to the housing, wherein the mandrel comprises a power mandrel and a ball operator mandrel;

a ball valve to allow or block flow through the tubing, wherein the mandrel is selectively moved to open the ball valve between each pressure test; and a circulating valve in the tubing.

30. The system of claim 29 further comprising a retainer to prevent further movement of the ball operator mandrel relative to the housing.

31. The system of claim 30 in which the retainer is a biased pin.

32. The system of claim 29 in which the power mandrel further comprises a first section and a second section, the first and second sections being releasably attached to each other, and the second section being disposed in a recess in the housing.

33. The system of claim 32 further comprising an injection port in the first section and a control line to deliver pressurized fluid into the recess.

34. The system of claim 33 in which motion of the second section relative to the first section allows fluid communication between the passageway and the control line.

35. The system of claim 33 in which the control line has a flow-limiting device therein.

36. The system of claim 29 in which the ball valve and mandrel are secured to prevent azimuthal rotation relative to the housing.

37. The system of claim 29 in which the mandrel has a selective profile to allow mechanical actuation of the ball valve.

38. A system to pressure test in a well, comprising:

a tubing having a passageway;

a housing coupled to the tubing;

a mandrel moveably attached to the housing;

a disk valve that may be pierced by the mandrel to allow flow through the tubing, wherein the mandrel can be selectively moved to pierce the disk valve; and a circulating valve in the tubing.

39. The system of claim 38 in which the mandrel has an end adapted to pierce the disk valve.

* * * * *